US005867099A

United States Patent [19]

Keeter

[11] Patent Number: 5,867,099

[45] Date of Patent: Feb. 2, 1999

[54] MOTION SENSING, LIGHTING AND ALARMING SYSTEM

[76] Inventor: Daniel R. Keeter, 704 La Paz Ct., Bakersfield, Calif. 93312

[21] Appl. No.: 977,242

[22] Filed: Nov. 24, 1997

[51] Int. Cl.[6] ..... G08B 13/18; F21V 23/04

[52] U.S. Cl. ..... 340/567; 340/565; 362/276; 362/394

[58] Field of Search ..... 340/567, 693, 340/539, 573, 506, 568, 565, 326, 321, 331; 250/342, DIG. 1; 362/276, 394, 419, 421, 802

[56] References Cited

U.S. PATENT DOCUMENTS

| | | | |
|---|---|---|---|
| 3,736,584 | 5/1973 | Hackett et al. | 367/94 |
| 3,803,474 | 4/1974 | Clark | 318/640 |
| 3,913,066 | 10/1975 | Kehry et al. | 340/426 |
| 4,125,779 | 11/1978 | Malinowski | 340/630 |
| 4,186,390 | 1/1980 | Enemark | 340/630 |
| 5,243,327 | 9/1993 | Bentz et al. | 340/566 |
| 5,309,145 | 5/1994 | Branch et al. | 340/567 |
| 5,381,323 | 1/1995 | Osteen et al. | 340/567 |
| 5,406,256 | 4/1995 | Ledel et al. | 340/539 |
| 5,422,532 | 8/1995 | Boulos et al. | 340/567 |
| 5,442,177 | 8/1995 | Boulos et al. | 340/567 |
| 5,463,595 | 10/1995 | Rodhall et al. | 367/93 |
| 5,477,205 | 12/1995 | Burns | 340/326 |
| 5,619,185 | 4/1997 | Ferraro | 340/568 |
| 5,662,411 | 9/1997 | Haslam et al. | 340/567 |
| 5,699,243 | 12/1997 | Eckel et al. | 364/140 |

*Primary Examiner*—Jeffery A. Hofsass
*Assistant Examiner*—Van T. Trieu
*Attorney, Agent, or Firm*—Richard C. Litman

[57] ABSTRACT

A motion sensing, lighting and alarming system includes a mounting base, a motion sensor and alarm housing pivotally mounted to the mounting base for receiving motion sensor and audible alarm electronics therein, a first swivel assembly for engaging the housing to the mounting base, a pair of light holders pivotally mounted to a mounting base, each for receiving a light therein, and a pair of second swivel assemblies for engaging the light holders to the mounting base and allowing the light holders to swivel with respect the mounting base. The mounting base also establishes electrical and mechanical connections with a source of 120 V.A.C. electrical power.

18 Claims, 5 Drawing Sheets

MOTION SENSING, LIGHTING AND ALARMING SYSTEM

BACKGROUND OF THE INVENTION

1. Field of the Invention

The present invention relates generally motion sensing and lighting systems, and more particularly, to a motion sensing, lighting and alarm system that includes an audible alarm which operates in conjunction with, or independently from, the lights.

2. Description of Related Art

Security lighting systems are widely used for prevention of crime and vandalism in many communities. These security systems are commonly used to monitor residential and business properties, particularly the areas encompassing entrances to buildings, during nighttime hours. One conventional security lighting system employs a light capable of illuminating a given protected area and a motion detector capable of turning on the light. The motion detector typically utilizes either ultrasound, infrared or some other suitable form of energy. The motion detector senses and is activated by the motion of an intruder or other individual entering into the given protected area which is being monitored by the motion detector. Activation of the motion detector, in turn, turns on the light to illuminate the protected area for a given period of time. However, one important drawback of the system is that it fails to alert the user of the system of the possible presence of an intruder.

The related art is represented by the following patents of interest.

U.S. Pat. No. 3,736,584, issued on May 29, 1973 to Kenneth R. Hackett et al., describes an intruder alarm system having a plurality of sound producing transducers designed to generate sound at a predetermined reference frequency. Hackett et al. do not suggest the motion sensing, lighting and alarm system according to the claimed invention.

U.S. Pat. No. 3,913,066, issued on Oct. 14, 1975 to Manfred Kehry et al., describes an alarm system for motor vehicles that provides for the emission of intermittent acoustic and/or optical alarm signals by means of a pulse transmitter, adapted to be turned on by way of a push-button reachable from the driver seat and adapted to be turned off by way of a further push-button reachable only from the outside. Kehry et al. do not suggest the motion sensing, lighting and alarm system according to the claimed invention.

U.S. Pat. No. 4,125,779, issued on Nov. 14, 1978 to William J. Malinowski, describes a smoke detector including a light-emitting diode and a photo-voltaic cell so arranged that the cell receives light from the diode reflected from smoke particles in ambient atmosphere, and circuit means for amplifying the cell output to provide an alarm output signal. Malinowski does not suggest the motion sensing, lighting and alarm system according to the claimed invention.

U.S. Pat. No. 4,186,390, issued on Jan. 29, 1980 to Robert B. Enemark, describes a scatter type of smoke detector. Enemark does not suggest the motion sensing, lighting and alarm system according to the claimed invention.

U.S. Pat. No. 5,243,327, issued on Sep. 7, 1993 to Allan J. Bentz et al., describes a small, compact motion detector alarm which emits an alarm sound when a low frequency vibration is detected. Bentz et al. do not suggest the motion sensing, lighting and alarm system according to the claimed invention.

U.S. Pat. No. 5,406,256, issued on Apr. 11, 1995 to Jeffrey W. Ledel et al., describes a motion detector which includes a motion-sensitive switch in series arrangement with a timing circuit, the timing circuit permitting activation of an encoder/transmitter circuit, which transmits a radio signal encoded according to the manual settings of encoder switches. A radio receiver receives the transmitted radio signal and develops corresponding signals into a decoder circuit which is selectively set with decoder switches to recognize only a predetermined sequence of input signals. A decoder output is connected to a latch circuit which in turn drives an audible or visible alarm. Ledel et al. do not suggest the motion sensing, lighting and alarm system according to the claimed invention.

U.S. Pat. No. 5,463,595, issued on Oct. 31, 1995 to Arne Rodhall et al., describes a portable security system including a motion detector and an alarm which is activated upon sensing an intrusion within a monitored area. Rodhall et al. do not suggest the motion sensing, lighting and alarm system according to the claimed invention.

None of the above inventions and patents, taken either singly or in combination, is seen to describe the instant invention as claimed.

SUMMARY OF THE INVENTION

The present invention is a motion sensing, lighting and alarming system which includes a mounting base, a motion sensor and alarm housing for receiving motion sensor and audible alarm electronics therein, a first swivel means for engaging the housing to the mounting base, a pair of light holders pivotally mounted to a mounting base, each for receiving a light therein, a pair of second swivel means for engaging the light holders to the mounting base and allowing the light holders to swivel with respect the mounting base. The mounting base also includes means for establishing electrical and mechanical connections with a source of 120 V.A.C. electrical power.

The motion sensor and alarm housing contains within it a motion sensor, a sensitivity adjuster for the motion sensor, an audible alarm, such as a 120 V.A.C. intermittent siren piezo sounder, a photocell, a sensitivity adjuster for the photocell, a manual-override switch, a duration switch, a three position double pole mini-slide switch, and a light emitting diode indicator. The audible alarm operates at about 90 decibels at about 2900 Hertz with a load of about 18 milliamperes. These features are located within the motion sensor and alarm housing which comes with a weatherproof cover plate. The motion sensing, lighting and alarming system may also include a black rubber cap to shunt the photocell for an extended period of time.

The light holders each have a tube portion having an open end for receiving a light. A light socket is installed in each tube portion for receiving a light. The tube portions include means thereby allowing electrical wires to pass from the tube portions through the pair of second swivel means. The light holders are each connected to the mounting base by a pivoting or swivel connection. The pivoting or swivel connections to the light holders may be conveniently made at the far end of the tube portions. The pivot mountings swivel about pivot positions that are offset from the far end of the tube portions.

Accordingly, it is a principal object of the invention to provide a motion sensing, lighting and alarming system which includes lights and an audible alarm that operate in conjunction with or independently from each other.

It is another object of the invention to provide a motion sensing, lighting and alarming system which includes a photocell, a sensitivity adjuster for the photocell, a manual-override switch, a duration switch, and a three position double pole mini-slide switch.

It is a further object of the invention to provide a motion sensing, lighting and alarming system which includes an audible alarm operates at about 90 decibels at about 2900 Hertz with a load of about 18 milliamperes.

It is an object of the invention to provide improved elements and arrangements thereof in a motion sensing, lighting and alarming system for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
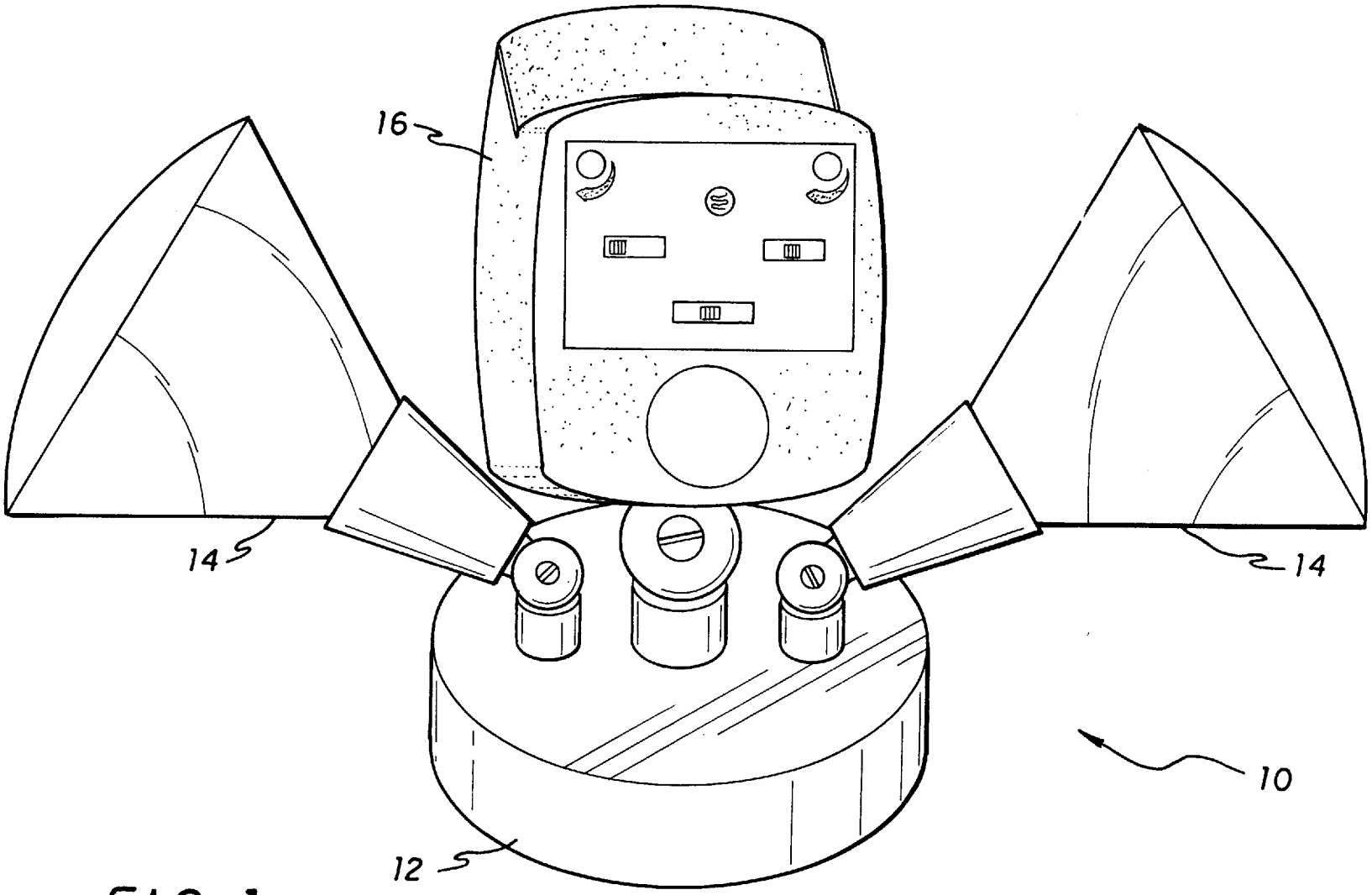
FIG. 1 is a bottom perspective view of the inventive motion sensing, lighting and alarming system.

The present invention relates to a motion sensing, lighting and alarming system, generally indicated by reference numeral 10 in FIG. 1. Basically, the motion sensing, lighting and alarming system 10 includes a mounting base 12, a motion sensor and alarm housing 16 pivotally connected to the mounting base 12 that includes contained therein a motion sensor 32, an audible alarm 18, and a control panel, and a pair of lights 14 supported in a pair of light holders pivotally connected to the mounting base 12.

The motion sensing, lighting and alarming system 10 utilizes 120 V.A.C. as a power source and also the output for driving any signals. This eliminates the concern for power consumption and for dead 9 volt batteries. A 9 volt power supply is highly dependent on power consumption, very erratic in performance and virtually eliminates any possibility of adding more signal loads to the 9 volt supply. In direct contradistinction thereto, with a 120 V.A.C output, the motion sensing, lighting and/or alarm system 10 can power up numerous other loads including additional flood lamps, additional remote buzzers, and 120 V.A.C. relays which can literally do almost anything, such as tie into existing home or commercial security systems, camera monitors and automatic phone dialers. The motion sensing, lighting and alarming system 10 includes necessary conductors for additional remote loads whether they may be additional lights or additional buzzers or any other preferable 120 V.A.C. loads.

The motion sensing, lighting and alarming system 10 includes a motion sensor and alarm housing 16 pivotally mounted the mounting base 12 for receiving motion sensor and audible alarm electronics therein, a first swivel means for engaging the housing 16 to the mounting base 12 and allowing the housing 16 to swivel with respect to the mounting base 12, a pair of light holders pivotally mounted to the mounting base 12, each for receiving a light 14 therein, and a pair of second swivel means for engaging the light holders to the mounting base 12 and allowing the light holders to swivel with respect the mounting base 12. The mounting base 12 also includes means for establishing electrical and mechanical connections with a source of 120 V.A.C. electrical power.

Figure 2:
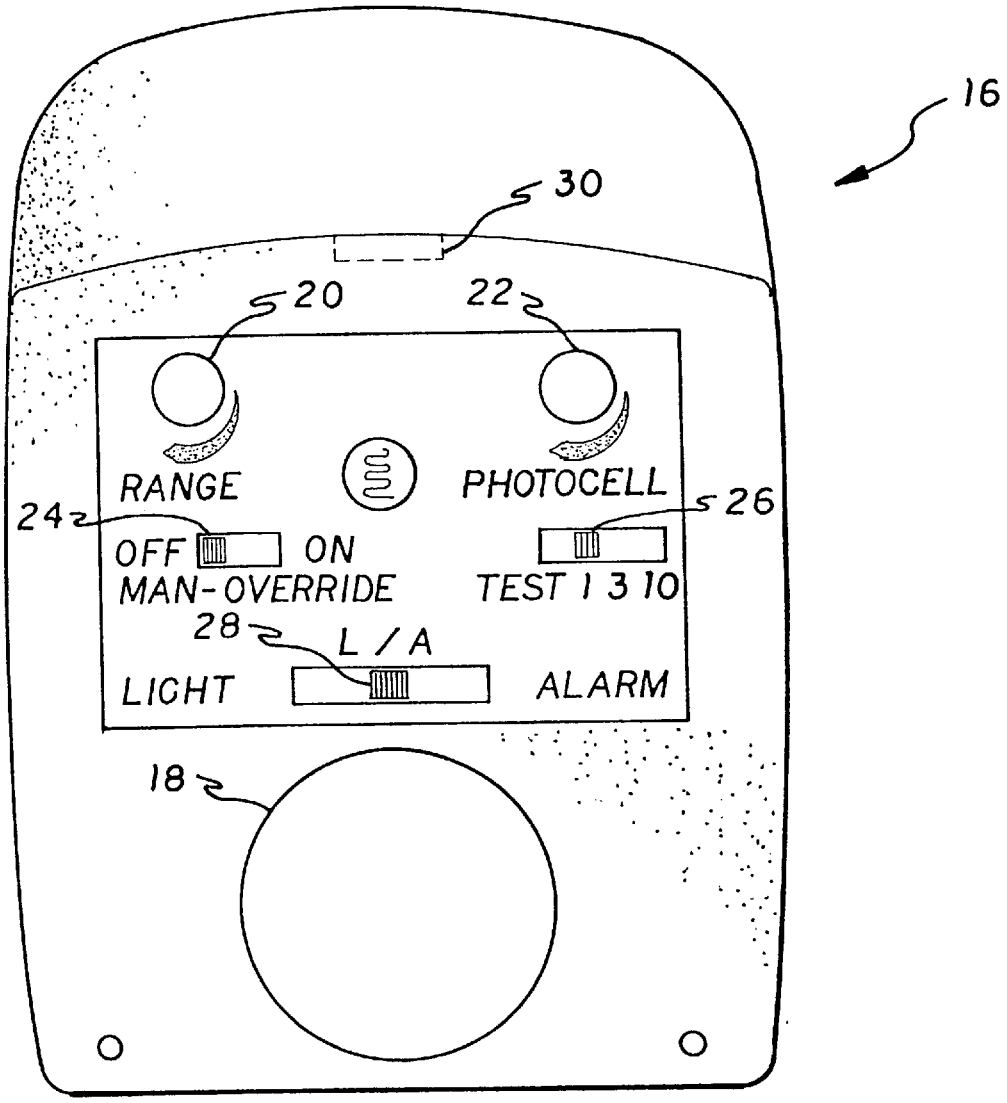
FIG. 2 is a close up bottom view of the inventive motion sensor and alarm housing.
Figure 3:
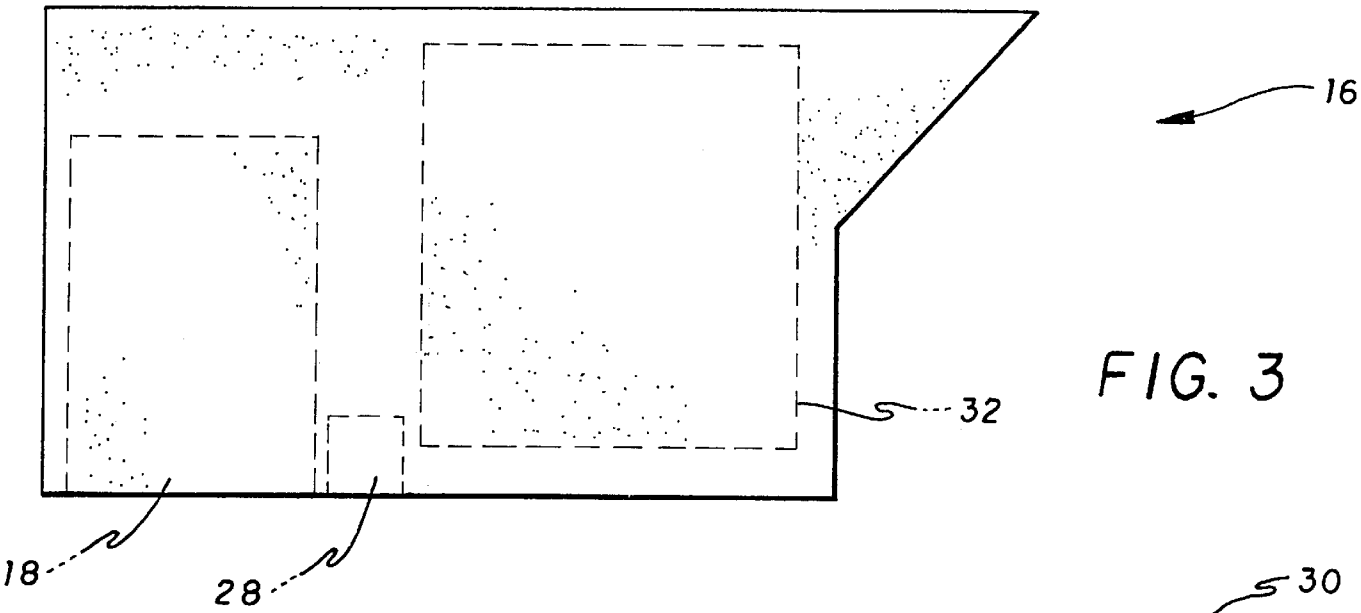
FIG. 3 is a side view of the inventive motion sensor and alarm housing.
Figure 4:
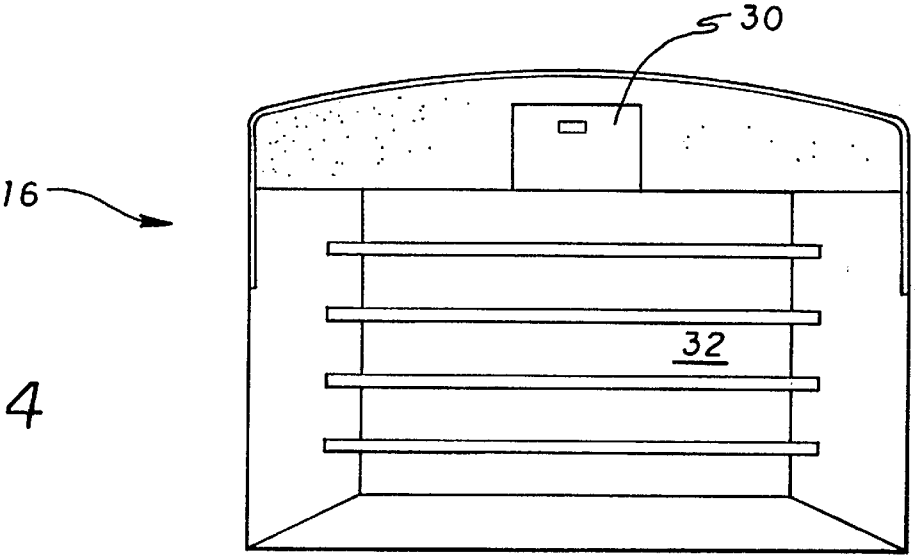
FIG. 4 is a front view of the inventive motion sensor and alarm housing.
Figure 5A:
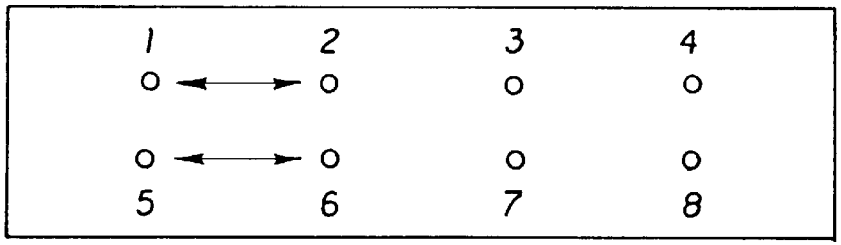
FIGS. 5A–5C are representations of a light/alarm switch of the inventive motion sensing, lighting and alarming system in each of its three positions.
Figure 5B:
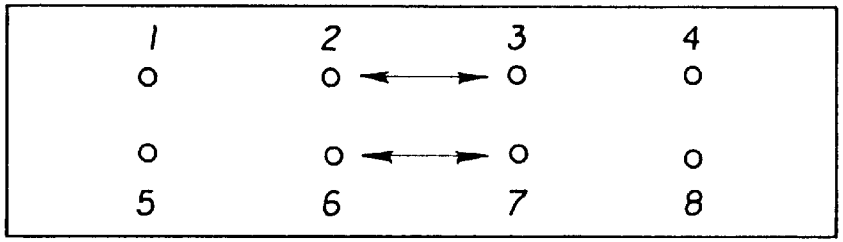
Figure 5C:
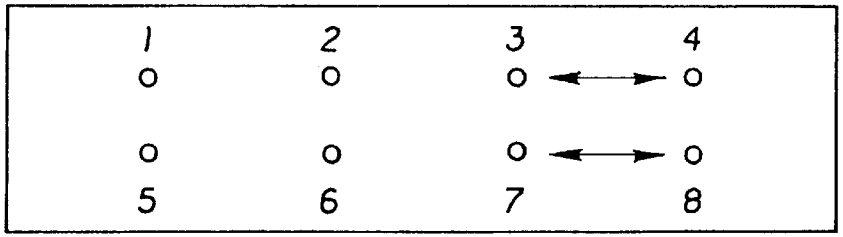
Figure 6:
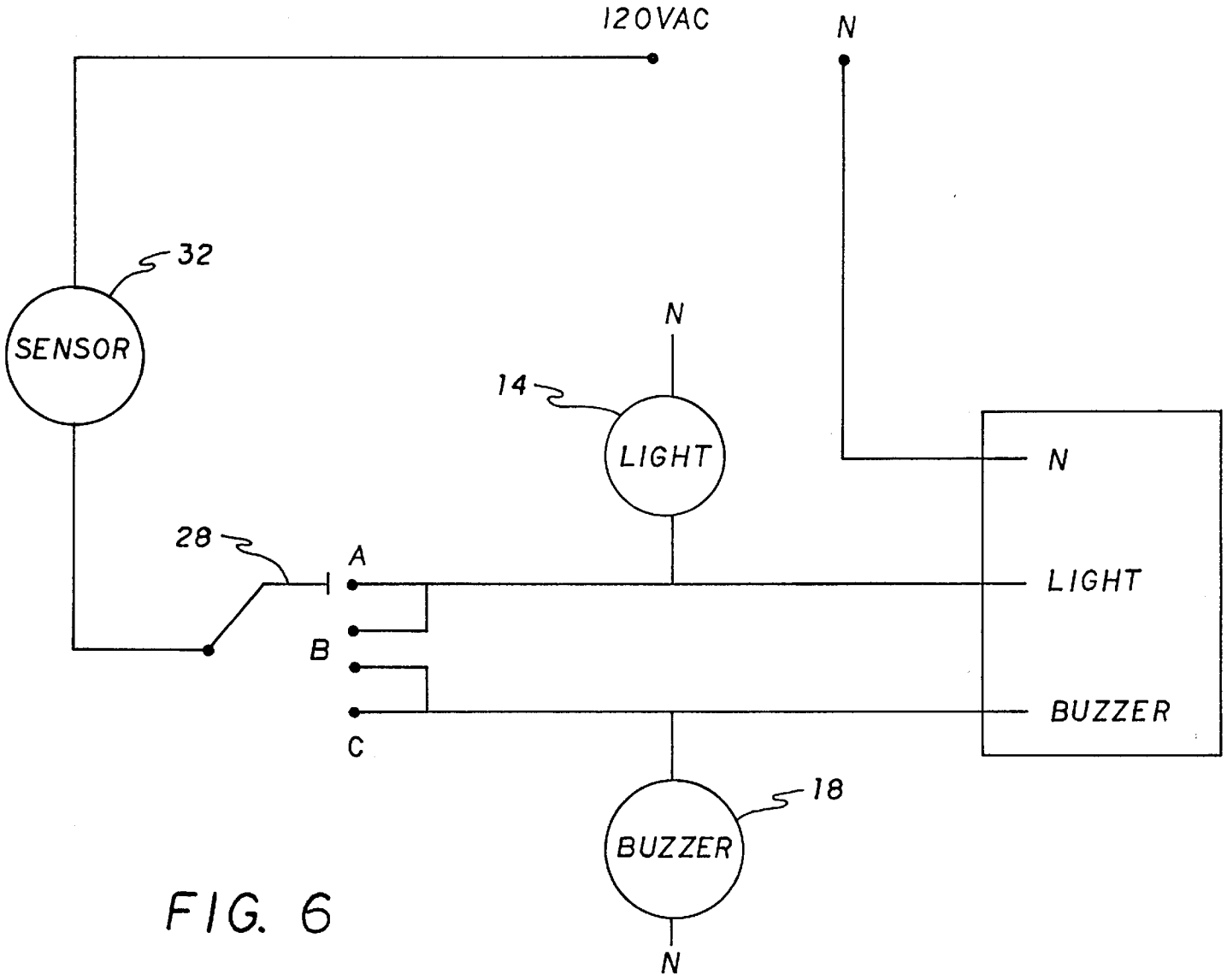
FIG. 6 is a block diagram of the inventive motion sensing, lighting and alarming system.

The motion sensor housing 16 contains within it a motion sensor 32 (best seen in FIG. 3), an audible alarm 18, preferably a 120 V.A.C. intermittent siren piezo sounder, a sensitivity adjuster 20 for the motion sensor 32, a photocell, a sensitivity adjuster 22 for the photocell, a manual-override switch 24, a duration switch 26, a three position double pole mini-slide switch 28, and an indicator light emitting diode 30, as shown in FIG. 2. The audible alarm 18 operates at about 90 decibels at about 2900 Hertz with a load of about 18 milliamperes. These features are located within the motion sensor and alarm housing 16 that comes with a weatherproof cover plate. The motion sensing, lighting and alarming system 10 may also include a black rubber cap to shunt the photocell for an extended period of time.

The light holders each have a tube portion having an open end for receiving a light 14. A light socket is installed in each tube portion for receiving a light 14. The tube portions include means thereby allowing electrical wires to pass from the tube portions through the pair of first swivel means. The light holders are each connected to the mounting base 12 by a pivoting or swivel connection. The pivoting or swivel connections to the light holders may be conveniently made at the far end of the tube portions. The pivot mountings swivel about pivot positions that are offset from the far end of the tube portions.

The pair of lights 14 are preferably a pair of flood lights capable of insertion respectively in the light holder sockets supported by the mounting base and capable of mounting the lights in an electrically connected relation. As examples, the pair of lights 14 can be 150-watt white constant flood lights. However, the pair of lights 14 may be any kind of lights.

The motion sensor 32 is preferably a passive infrared motion detector. Such detectors have about a 120° arc and about a 50 foot range detection zone. However, motion detectors are known having a different arc or range detection zone, such as up to 500 feet. Suitable alternate motion detectors may also be utilized, such as ultrasonic, optical, microwave, or video motion detectors. Additional alternative types of motion detectors which may also be utilized to sense intrusion include laser scanning or frequency sensitive detectors, commonly referred to as "glass breaks".

The motion sensing, lighting and alarming system 10 includes an internal electrical circuit arrangement which electrically interconnects the pair of lights 14 and the motion sensor and alarm housing 16 with an electrical power supply providing means, such as a source of 120 V.A.C. electrical power, so as to cause activating of the audible alarm 18 and/or the pair of lights 14 for a predetermined time in response to the motion sensor 32 sensing motion in a predetermined area monitored by the motion sensor 32.

The motion sensing, lighting and alarming system 10 can operate in one of three modes. The three modes include a light mode, an alarm mode, and an light/alarm mode. The user of the motion sensor utilizes the three position double pole mini-slide switch 28 to select the particular mode desired. If the light mode is selected, then only the lights 14 will respond to motion detected by motion sensor 32. If the alarm mode is selected, then only the audible alarm 18 will respond to motion detected by motion sensor 32. If the light/alarm mode is selected, then both the lights 14 and the audible alarm 18 will respond to motion detected by motion sensor 32.

Once the motion sensing, lighting and alarming system 10 is hooked up electrically, the user adjusts the sensitivity of the motion sensor by adjusting sensitivity adjuster 20 and adjusts the sensitivity of the photocell by adjusting sensitivity adjuster 22 with the duration switch 26 set in the test position. Also, the user decides if the situation or application warrants night use or whether it warrants twenty-four hour operation. If night operation is selected then the duration switch 26 is placed in either the one minute position, for one minute duration, the three minute position, for three minute duration, or the ten minute position, for ten minute duration. In the test position of the duration switch 26, the motion sensor 32 will work in the twenty-four hour mode but will only work for approximately ten seconds at a time which is really ideal for certain applications.

If the twenty-four hour operation of the motion sensing, lighting and alarming system 10 is desired and durations longer than ten seconds are desired, then a black rubber cap is placed over the photocell lens. The user then selects time durations of either one, three, or ten minutes. It is recommended that the motion sensor 32 be hooked to a switched circuit of some sort for easy manipulation of the sensor 32. This would include devices such as a time clock, a limit switch, toggle switch, etc. It is also recommended that a qualified electrician make the installation, however noting that the installation is easy enough for the common handy person. An appliance cord can also be connected to the motion sensing, lighting and alarming system 10 for the convenience of utilizing the motion sensing, lighting and alarming system 10 in an otherwise unique problematic location.

If for some reason the lights 14 are not desired as in a garage security application, or a large warehouse security application, or in any security situation where the location of the motion sensing, lighting and alarming system 10 is to remain unobvious, then the assembly or attachment of the light holders to the mounting base 12 can be eliminated and the motion sensing, lighting and alarming system 10 can be placed in the alarm mode exclusively.

It is to be understood that the present invention is not limited to the sole embodiment described above, but encompasses any and all embodiments within the scope of the following claims.

I claim:

1. A motion sensing, lighting and alarming system comprising:

a mounting base;

a motion sensor and alarm housing comprising within it an audible alarm, a motion sensor for sensing motion in a predetermined area, a sensitivity adjuster for said motion sensor, a photocell, a sensitivity adjuster for said photocell, a manual-override switch, a duration switch, an indicator light emitting diode, and a three position double pole mini-slide switch which includes a light only position, a light and alarm position, and an alarm only position;

a first swiveling means for pivotally connecting said motion sensor and alarm housing to said mounting base; and means for establishing electrical and mechanical connections between a source of 120 V.A.C. electrical power and said mounting base and said motion sensor and alarm housing;

wherein said audible alarm is immediately activated when said mini-slide switch is in the alarm only position or the light and alarm position and said motion sensor senses motion.

2. The motion sensing, lighting and alarming system according to claim 1, wherein said audible alarm is a 120 V.A.C. intermittent siren piezo sounder that operates at about 90 decibels at about 2900 Hertz with a load of about 18 milliamperes.

3. The motion sensing, lighting and alarming system according to claim 1, wherein said motion sensor is a passive infrared motion detector.

4. The motion sensing, lighting and alarming system according to claim 1, wherein said motion sensor is selected from the group consisting of ultrasonic, optical, microwave, and video motion detectors.

5. The motion sensing, lighting and alarming system according to claim 1, wherein said motion sensor is selected from the group consisting of laser scanning and frequency sensitive detectors.

6. The motion sensing, lighting and alarming system according to claim 1, wherein said duration switch includes a test position, a one minute position, a three minute position, and a ten minute position.

7. The motion sensing, lighting and alarming system according to claim 1, further comprising a pair of light holders and a pair of second swivel means for pivotally connecting said pair of light holders to said mounting base.

8. The motion sensing, lighting and alarming system according to claim 7, further comprising a light socket mounted in each light holder.

9. The motion sensing, lighting and alarming system according to claim 8, further comprising a light connected to each light socket.

10. The motion sensing, lighting and alarming system according to claim 9, wherein said lights are 150-watt white constant flood lights.

11. A motion sensing, lighting and alarming system comprising:

a mounting base;

a motion sensor and alarm housing comprising within it an audible alarm, a motion sensor for sensing motion in a predetermined area, a sensitivity adjuster for said motion sensor, a photocell, a sensitivity adjuster for said photocell, a manual-override switch, a duration switch, an indicator light emitting diode, and a three position double pole mini-slide switch which includes a light only position, a light and alarm position, and an alarm only position;

a first swiveling means for pivotally connecting said motion sensor and alarm housing to said mounting base;

means for establishing electrical and mechanical connections between a source of 120 V.A.C. electrical power and said mounting base and said motion sensor and alarm housing;

a pair of light holders;

a light socket mounted in each light holder; and a pair of second swivel means for pivotally connecting said pair of light holders to said mounting base;

wherein said audible alarm is immediately activated when said mini-slide switch is in the alarm only position or the light and alarm position and said motion sensor senses motion.

12. The motion sensing, lighting and alarming system according to claim 11, further comprising a light connected to each light socket.

13. The motion sensing, lighting and alarming system according to claim 12, wherein said lights are 150-watt white constant flood lights.

14. The motion sensing, lighting and alarming system according to claim 11, wherein said audible alarm is a 120 V.A.C. intermittent siren piezo sounder that operates at about 90 decibels at about 2900 Hertz with a load of about 18 milliamperes.

15. The motion sensing, lighting and alarming system according to claim 11, wherein said duration switch includes a test position, a one minute position, a three minute position, and a ten minute position.

16. The motion sensing, lighting and alarming system according to claim 11, wherein said motion sensor is a passive infrared motion detector.

17. The motion sensing, lighting and alarming system according to claim 11, wherein said motion sensor is selected from the group consisting of ultrasonic, optical, microwave, and video motion detectors.

18. The motion sensing, lighting and alarming system according to claim 11, wherein said motion sensor is selected from the group consisting of laser scanning or frequency sensitive detectors.

* * * * *